United States Patent [19]

Robbins

[11] 4,026,223

[45] May 31, 1977

[54] SLUDGE INCINERATOR

[75] Inventor: Dean Robbins, Sherwood, Oreg.

[73] Assignee: Chem. Pure West, Inc., Salem, Oreg.

[22] Filed: Jan. 29, 1976

[21] Appl. No.: 653,503

[52] U.S. Cl. ..... 110/7 B; 110/8 A; 110/8 C; 110/165 R

[51] Int. Cl.[2] ..... F23G 5/12; F23J 1/00

[58] Field of Search ..... 110/7 R, 7 B, 7 S, 8 A, 110/8 R, 8 C, 10, 15, 165 R

[56] References Cited

UNITED STATES PATENTS

| | | | |
|---|---|---|---|
| 3,064,593 | 11/1962 | Burk et al. | 110/8 |
| 3,500,775 | 3/1970 | Hubbard | 110/8 |
| 3,559,595 | 2/1971 | Kassel et al. | 110/7 |
| 3,563,187 | 2/1971 | Zanft | 110/7 |
| 3,780,674 | 12/1973 | Liw | 110/8 |
| 3,822,653 | 7/1974 | Ghelfi | 110/8 |

*Primary Examiner*—Kenneth W. Sprague
*Attorney, Agent, or Firm*—Oliver D. Olson

[57] ABSTRACT

A sludge incinerator for use in the flash evaporation of water contained in high moisture sludges comprises a primary chamber, with longitudinally spaced inlet tubes to introduce the sludge and compressed air therein in an atomized spray, and primary burners intermediate the inlet tubes, to heat and burn the sludge, thus separating it into dry solids and water vapor. A screw conveyor removes the dry solids from the primary chamber. An afterburner, including secondary burners, a secondary air supply, and a mixing chamber to mix the secondary air with the primary combustion products, provides further oxidation to achieve substantially complete combustion of the combustibles content of the sludge and fuel. A vertical stack exhausts these combustibles and vapors from the mixing chamber.

11 Claims, 3 Drawing Figures

SLUDGE INCINERATOR

BACKGROUND OF THE INVENTION

This invention relates to an incinerator for the evaporative separation of sludge into water vapor and dry solids.

Sludge incinerators heretofore have been provided to obtain this separation. The prior art incinerators, however, have been able to process only a relatively low volume of sludge. Further, they have required large centrifuges to affect complete separation of the water, particularly with high solid sludges. Moreover, the fuel to sludge ratio of the prior sludge incinerators has been quite high, resulting in costly operation thereof.

SUMMARY OF THE INVENTION

In its basic concept, the sludge incinerator of this invention provides a primary chamber and associated longitudinally spaced alternate sludge inlet tubes and primary burners to flash evaporate water from high moisture sludges, and to separate combustible and non-combustible components. An afterburner also may be provided to insure substantially complete oxidation of the resulting products of combustion essentially to pure water and carbon dioxide.

It is by virtue of the foregoing basic concept that the principal objective of this invention is achieved; namely, to overcome the aforementioned disadvantages and limitations of prior sludge incinerators.

Another object of this invention is to provide a sludge incinerator of the class described wherein the sludge is reduced substantially to dry solids, pure water and carbon dioxide.

Still another object of this invention is to provide a sludge incinerator of the class described which may be automatically controlled for continuous operation.

A further object of this invention is to provide a sludge incinerator of the class described which is of simplified construction for economical manufacture and is of rugged design permitting long, continuous use with minimum maintenance and repair.

The foregoing and other objects and advantages of this invention will appear from the following detailed description taken in conjunction with the accompanying drawings of a preferred embodiment.

DESCRIPTION OF THE PREFERRED EMBODIMENT

Figure 1:
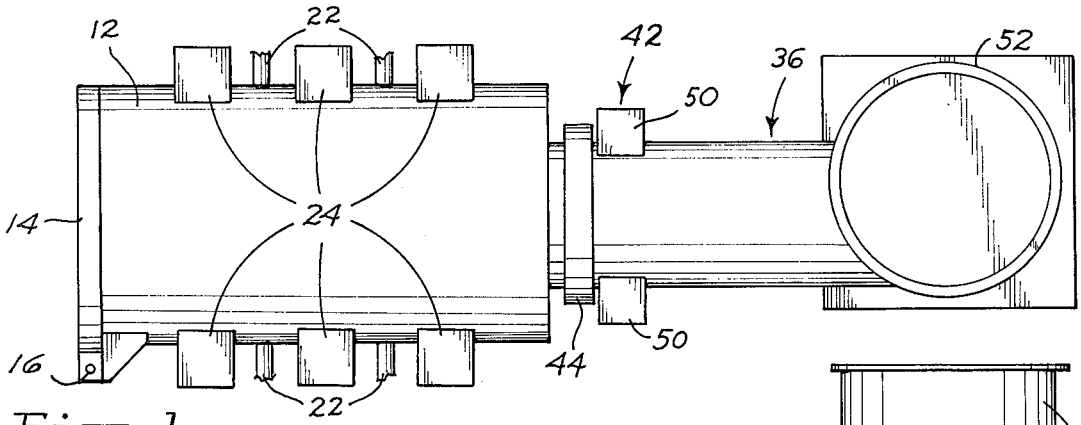
FIG. 1 is a plan view of a sludge incinerator embodying the features of this invention.

Referring to the drawings, the sludge incinerator includes a primary chamber 10 formed of an elongate, cylindrical tank 12, generally closed at both ends. Since the sludge incinerator operates at sustained high temperatures, the primary chamber is provided with a refractory lining 12'. One end of the primary chamber comprises door 14 pivotally mounted to the cylindrical tank by such means as hinge 16, and sealable in the closed position by such means as a latch (not shown). A view port (not shown) may be included in the door to allow visual access to the primary chamber when the sludge incinerator is in operation.

The primary tank 12 may be supported by any desired form of structural support. In the embodiment illustrated, a post and beam base 18 with side supports 20 is utilized to support it in a substantially horizontal position.

Feed means, such as inlet tubes 22, are included to feed the raw sludge into the primary chamber 10. Preferably, several such tubes are provided and are medially positioned on both sides of the primary chamber substantially along its horizontal center line at longitudinally spaced intervals. The tubes are Y-shaped to allow introduction of compressed air from a source (not shown) through branch tube 22', along with the sludge from main tube 22 in order to maximize atomization of the sludge and thereby promote complete combustion. In the preferred embodiment, the sludge is pressurized to expedite its passage into the primary chamber. The pressure of the sludge, however, should be somewhat less than that of the compressed air. Thus, for example, where the sludge is supplied at 50–60 pounds per square inch gauge, the compressed air should be supplied at about 80 pounds per square inch gauge. Check valves (not shown) in the main tubes 22 upstream of the branch tubes 22' prevent the higher pressure air from backing up through the sludge tubes. Conventional high pressure spray nozzles (not shown) are located at the inner ends of the tubes 22 to atomize the sludge-air mixture and inject it into the primary chamber. If desired, waste oil or other flammable hydrocarbons may be introduced along with the sludge to aid in the ignition of the sludge.

Primary burners 24 are mounted in the primary chamber to effectuate flash evaporization of the water contained in the sludge and incineration of the solids content of the sludge. In the embodiment illustrated, six propane fired, full modulating burners are provided, three on each side of the primary chamber located approximately at its horizontal center line at longitudinally spaced intervals, bracketing the pair of sludge inlet tubes 22. Other types of primary burners and sources of combustible gases may be utilized for this purpose, if desired.

Figure 2:
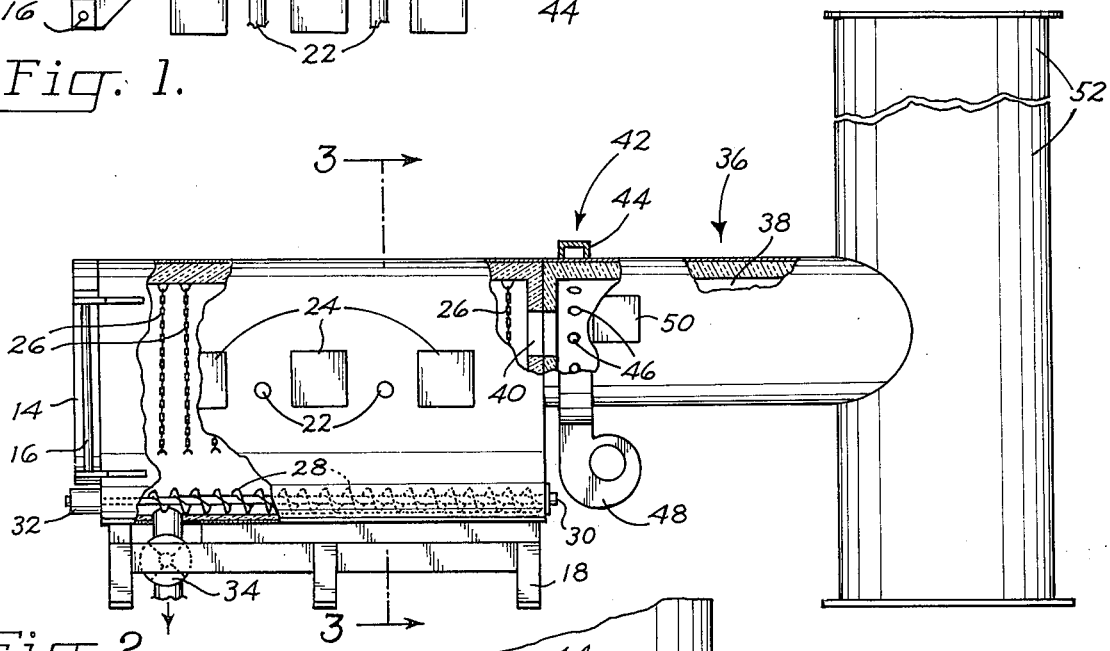
FIG. 2 is a foreshortened elevation view as viewed from the bottom FIG. 1, portions being broken away to disclose details of internal construction.
Figure 3:
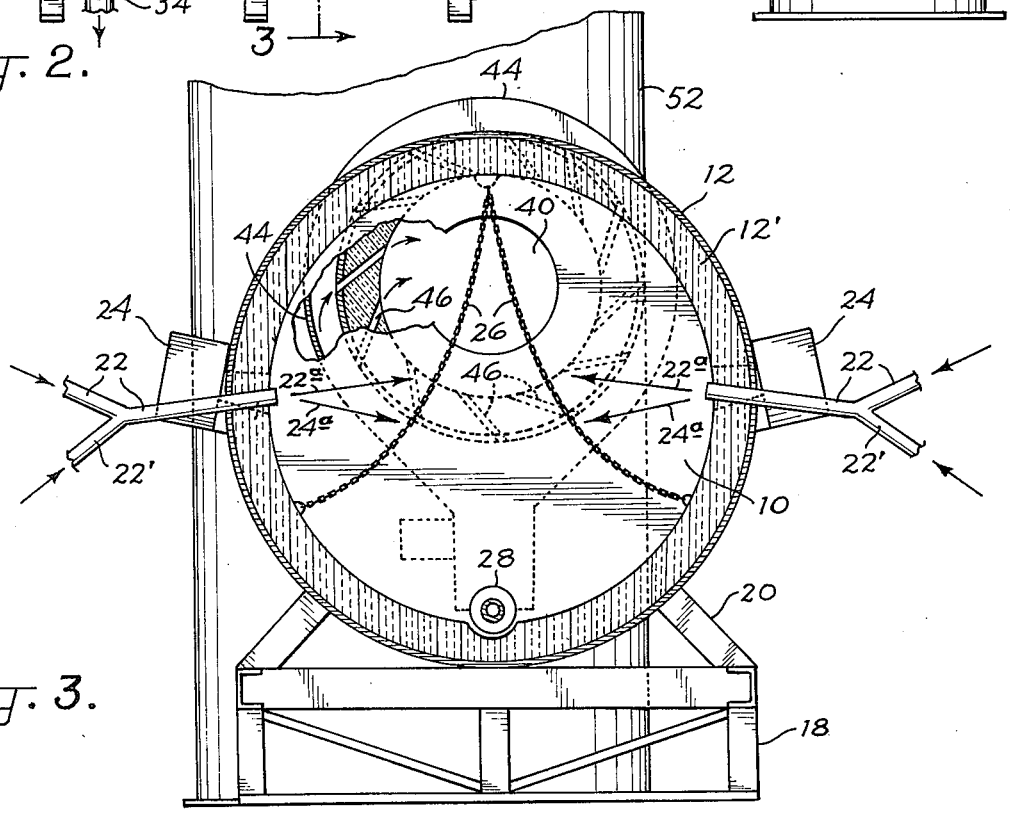
FIG. 3 is a sectional view taken along the line 3—3 in FIG. 2.

To further enhance the efficiency of operation and hence increased production of the incinerator, lengths of mild steel chain 26 may be draped downward from the top of the chamber 10 to opposite sides thereof, as illustrated in FIGS. 2 and 3. Preferably, the lengths of chain of spaced apart longitudinally of the chamber 10, for example about 6 to 12 inches. Thus, they pick up the flame directly from the burners 24 and become red hot. They retain such heat and thereby provide a multiplicity of hot surfaces from which to aid in the flash evaporation of volatile components of the sludge.

In the preferred embodiment illustrated, and best shown in FIG. 3, the sludge inlet tubes are disposed to inject the sludge-air mixture into the chamber at an angle slightly inclining from horizontal, as indicated by the arrows **22*a*, while the burners inject fuel-air mixture into the chamber at an angle slightly declining from horizontal, as indicated by the arrows 24*a***. This arrangement has been found to provide substantially maximum mixing of the sludge spray and gases of combustion within the chamber.

Conveyor means is located on the bottom portion of the primary chamber to convey the non-combustible solids out of the primary chamber. For this purpose, air-cooled screw conveyor 28 is rotatably mounted in the primary chamber by bearing 30 at one end and motor 32 at the other end. The dry solids are then passed out of the primary chamber through an air lock, such as rotary valve 34 located below the end of the air-cooled screw conveyor in the bottom of the primary chamber.

Afterburner 36 is mounted to the upper portion of the downstream end of the primary chamber. It includes a secondary chamber 38 formed of an elongate cylindrical tank similar to that used for the primary chamber, however approximately one-half of its diameter. The primary and secondary chambers are interfaced by flame port 40 which comprises a short cylindrical orifice. Due to the high pressure maintained in the primary chamber, the primary combustion products pass through the flame port into the secondary chamber.

Pressurized secondary air is introduced into the afterburner through mixing chamber 42 located about the periphery of the secondary chamber immediately downstream from the flame port. The mixing chamber includes an annular air supply duct 44 which is located outside the secondary chamber and opens therein. Air passageways 46 are located through the secondary chamber wall, communicating the annular air supply duct with the interior of the chamber. They are oriented substantially tangentially to the flame port to induce turbulent mixing of the secondary air with the primary combustion products. A motor-driven axial fan 48 is located in an opening in the lower portion of the annular air supply duct to pressurize the secondary air.

Reignition burners 50 are mounted in the side walls of the secondary chamber adjacent the duct 44 to further oxidize the mixed primary combustion products. They comprise propane fired burners similar to those used for the primary burners. Two such burners are illustrated, one on each side of the secondary chamber approximately at its horizontal center line. Preferably, these burners 50 are arranged to inject flame into the chamber 38 substantially tangentially, to enhance mixing of its gases of combustion with the combustion products of the primary chamber 10.

A vertical stack 52 is located downstream of the afterburner at the end of the secondary chamber 38 opposite primary chamber 10, to transmit the vaporized water and gases of combustion to the atmosphere. Although the stack may serve to create natural draft for this purpose of transporting the products of combustion to the atmosphere, forced draft may be provided if desired or required, as will be understood. Condensation means (not shown) may be positioned in the vertical stack to condense the water for further use, if desired. The afterburner preferably enters the stack tangentially, as illustrated, to effect centrifugal separation of any solids entering the stack.

Since the reduction of the sludge is obtained almost completely by flash evaporation and afterburning, little flushing of the system is required. Thus, if desired, the operation of the sludge incinerator can be automated for continuous operation. Controls and interlocks (not shown) may be included to tie the operation of all of the elements.

In the operation of the sludge incinerator of the present invention, inlet tubes 22 are connected to a supply of raw sludge. Generally, the sludge is stored in a receiving tank (not shown) until fed into the sludge incinerator. The stored sludge is preferably agitated and fed out of the receiving tank through a macerator to uniformly size the sludge materials. A pump may be utilized to pressurize the sludge.

The pressurized sludge in tubes 22 and compressed air in tubes 22' are then injected into the primary chamber as an atomized spray by high pressure spray nozzles located at the inner ends of inlet tubes 22. Since the sludge is injected at the locations bracketed by primary burners 24, it is rapidly heated and oxidized to flash evaporate the water contained therein and oxidize the combustibles content to gaseous phase. The solids gravitate to the bottom of the primary chamber where they are removed by screw conveyor 28.

The resulting water vapor and any unburnt products of combustion pass through flame port 40 and are mixed with pressurized secondary air in mixing chamber 42. The reignition burners then reignite and further oxidize this mixture to provide essentially pure water vapor and completely oxidized gaseous combustion products. The water vapor may be recovered by condensation for re-use, if desired. If the gaseous combustion products include odoriferous compounds, they may be collected in conventional manner.

It will be apparent to those skilled in the art that various changes may be made in the size, shape, type, number and arrangement of parts described hereinbefore. For example, six-1,750,000 BTU propane fired primary burners will process approximately 300 gallons of sludge per hour. Other types or sizes of burners, types of fuel, and burner locations would also suffice, however. Furthermore, although the sludge incinerator illustrated utilizes horizontally mounted primary and secondary chambers, other shapes and orientations may be utilized. The screw conveyor 28 may be omitted if the incinerator is to be used with sludge having little ash, in which case the ash accumulation may be removed periodically by a vacuum head, scraper, or other suitable means. The chains 26 may be arranged in a variety of ways, other than as illustrated. For example, a single row of longitudinally spaced chains may hang freely from hangers located at the top center of the chamber. Alternatively, a plurality of laterally spaced, longitudinal rows may hang freely from laterally spaced hangers. These and other modifications may be made as desired without departing from the spirit of this invention.

Having now described my invention and the manner in which it may be used, I claim:

1. A sludge incinerator for evaporative separation of water, combustibles and non-combustible solids from a high moisture sludge, comprising:

a. an elongated primary chamber, b. a plurality of sludge infeed means disposed at longitudinally spaced intervals in the primary chamber for feeding sludge into the primary chamber, and c. a plurality of primary burners mounted in the primary chamber at longitudinally spaced intervals bracketing the infeed means for flash evaporating the water from the sludge and igniting the combustible content of the sludge.

2. The sludge incinerator of claim 1 wherein a plurality of the sludge infeed means and a plurality of the primary burners are mounted in each of the opposite side walls of the primary chamber and are directed toward the opposite side walls.

3. The sludge incinerator of claim 2 wherein the sludge infeed means and primary burners are arranged to inject their contents into the primary chamber at oppositely inclined angles relative to horizontal.

4. A sludge incinerator for evaporative separation of water, combustibles and non-combustible solids from a high moisture sludge, comprising:

a. an elongated primary chamber, b. a plurality of sludge infeed means diposed at longitudinally spaced intervals in the primary chamber for feeding sludge into the primary chamber, c. a plurality of primary burners mounted in the primary chamber at longitudinally spaced intervals between the infeed means for flash evaporating the water from the sludge and igniting the combustible content of the sludge, and d. a plurality of lengths of metal chain in the primary chamber spaced apart longitudinally thereof and extending downward from the top of the chamber for impingement of flame from the primary burners.

5. A sludge incinerator for evaporative separation of water, combustibles and non-combustible solids from a high moisture sludge, comprising:

a. an elongated primary chamber, b. a plurality of sludge infeed means disposed at longitudinally spaced intervals in the primary chamber for feeding sludge into the primary chamber, c. a plurality of primary burners mounted in the primary chamber at longitudinally spaced intervals between the infeed means for flash evaporating the water from the sludge and igniting the combustible content of the sludge, and d. afterburner means communicating with and extending from one end of the primary chamber to further oxidize the primary combustion products, the afterburner comprising:

1. a secondary chamber, 2. a flame port connecting the secondary chamber to the primary chamber, 3. a mixing chamber located about the periphery of the secondary chamber immediately downstream from the flame port, 4. secondary air supply means for supplying pressurized secondary air into the mixing chamber, and 5. re-ignition burners mounted in the secondary chamber downstream of mixing chamber.

6. The sludge incinerator of claim 5 wherein the secondary chamber comprises an elongate cylindrical tank of a diameter approximately one-half that of the primary chamber.

7. The sludge incinerator of claim 6 wherein the secondary chamber is joined to one upper end portion of the primary chamber.

8. The sludge incinerator of claim 5 wherein the mixing chamber comprises;

a. an annular air supply duct located exteriorly of the secondary chamber, and b. a plurality of passageways through the wall of the secondary chamber communicating the annular supply duct with the interior of the secondary chamber substantially tangentially to the flame port to induce turbulent mixing of the secondary air with the primary combustion products.

9. The sludge incinerator of claim 5 wherein the secondary air supply means comprises a motor-driven fan.

10. The sludge incinerator of claim 5 wherein the reignition burners are mounted in the opposite side walls of the secondary chamber approximately at its horizontal center line.

11. The sludge incinerator of claim 5 including a vertical stack located downstream of the afterburner means to transmit the vaporized water gaseous combustion products out of the sludge incinerator.

* * * * *

UNITED STATES PATENT AND TRADEMARK OFFICE

CERTIFICATE OF CORRECTION

PATENT NO. : 4,026,223

DATED : 31 May, 1977

INVENTOR(S) : Dean Robbins

It is certified that error appears in the above-identified patent and that said Letters Patent are hereby corrected as shown below:

Column 6, line 37, after "water" insert --and--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*